US007893369B2

(12) United States Patent
Wang

(10) Patent No.: US 7,893,369 B2
(45) Date of Patent: Feb. 22, 2011

(54) RATCHET WHEEL MECHANISM AND TURNING SWITCH WITH RATCHET WHEEL MECHANISM

(75) Inventor: Yang Wang, Dongguan (CN)

(73) Assignee: Illinois Tool Works Inc., Glenview, IL (US)

( * ) Notice: Subject to any disclaimer, the term of this patent is extended or adjusted under 35 U.S.C. 154(b) by 35 days.

(21) Appl. No.: 12/540,086

(22) Filed: Aug. 12, 2009

(65) Prior Publication Data

US 2010/0044193 A1 Feb. 25, 2010

(30) Foreign Application Priority Data

Aug. 22, 2008 (CN) ..... 2008 1 0210099

(51) Int. Cl.
*H01H 19/11* (2006.01)

(52) U.S. Cl. ..... 200/11 R

(58) Field of Classification Search ..... 200/11 R, 200/565, 61.15, 61.58 B, 426, 38 BA, 406, 200/461; 74/575

See application file for complete search history.

(56) References Cited

U.S. PATENT DOCUMENTS 2,889,419 A * 6/1959 Miller et al. ..... 200/38 BA
3,830,444 A * 8/1974 Sargeant ..... 242/382.1
4,360,720 A * 11/1982 Alsch ..... 200/426
6,109,556 A * 8/2000 Kopetzky et al. ..... 242/382.2

* cited by examiner

*Primary Examiner*—Edwin A. Leon
(74) *Attorney, Agent, or Firm*—Lowe Hauptman Ham & Berner LLP

(57) ABSTRACT

In the present invention are disclosed a step type ratchet wheel mechanism and a turning switch with step type ratchet wheel mechanism, wherein comprising: camshaft circular disc, on its end surface is disposed at least one groove, on its rim is disposed at least one positioning slot; driving cam, on its end surface is disposed at least one groove, on its rim is disposed at least one angular shape tooth; first pawl and second pawl; one resilient element is contained in the chamber, which is formed from two corresponding grooves respectively disposed on the end surfaces of camshaft circular disc and driving cam. When said camshaft circular disc is at a control-position, first pawl falls into one positioning slot of camshaft circular disc; when said driving cam is being turned toward next control-position, said two grooves will be staggered, said resilient element is compressed; when said driving cam is turned to the next control-position, one angular shape tooth will push first pawl out from said positioning slot, the released resilient element will cause said camshaft circular disc turning to the next control-position, and then second pawl will fall into another positioning slot of camshaft circular disc. In use of the present invention, the acted force is even, the operation is steady, the hand handle is comfortable, and furthermore, the phenomenon of hung-up point between two adjacent control-positions also may be avoided.

16 Claims, 13 Drawing Sheets

A - A

D – D

F – F

B – B

C – C

RATCHET WHEEL MECHANISM AND TURNING SWITCH WITH RATCHET WHEEL MECHANISM

RELATED APPLICATIONS

The present application is based on, and claims priority from, Chinese Application No. 200810210099.2, filed Aug. 22, 2008, the disclosure of which is hereby incorporated by reference herein in its entirety.

FIELD OF THE ART

The present invention relates to a ratchet wheel mechanism and a turning switch, especially relates to a step type ratchet wheel mechanism and a turning switch with step type ratchet wheel mechanism.

BACKGROUND OF THE ART

Turning switch is a common switch configuration. The ratchet wheel positioning mechanism will help turning switch to effect the mechanical configuration of turning switch implementing switchover from one control-position to next control-position and then instantly to lock the mechanical configuration at the next control-position, when there are several control positions needed to be controlled by a turning switch.

Generally, the ratchet wheel mechanism of turning switch has two main functions: Non-returning and positioning function, i.e. to prevent turning switch from coming back to its previous control-position and to lock turning switch at a certain control-position in turning operation; Snap-jumpiness function to indicate the turning switch already being turned to position, i.e. when the turning switch is turned to a certain control-position, the switch configuration may send out a snap or a jumpiness to cause operator be able to distinctly perceive the turning switch already being turned to an expected position in order to prevent the operator from stopping the turning operation before achieving next switch control-position or from continuing the turning operation after already achieving an expected switch control-position.

Now, a description about the functions of a ratchet wheel mechanism of the prior art in turning switch is made through FIGS. 1A to 1E.

FIG. 1A is a schematic diagram to show said ratchet wheel mechanism 100 at still (initial) position, wherein comprising: ratchet wheel 110 co-axial with camshaft and pawl device 120. Ratchet wheel 110 has 6 ratchet teeth 111 (111$._A$, 111$._B$, 111$._C$, 111$._D$, 111$._E$, 111$._F$) to divide the circular rim into six equal segments. Pawl device 120 has two transversal pawl arms 121 (121$._A$, 121$._B$) symmetrically disposed along height direction (relative to the axis of camshaft), on two transversal pawl arms 121 (121$._A$ and 121$._B$) respectively exists a pawl 122 (122$._A$, 122$._B$), they are symmetrically disposed along height direction, transversal pawl arms 121 and pawls 122 are made from resilient material, such as plastic, etc. Ratchet wheel 110 and pawl device 120 may be made from Nylon. As shown in FIG. 1A, ratchet wheel 110 and pawl device 120 are matched each other at a certain control-position. Saying concretely, at this control-position, upper ratchet pawl 122$._A$ is between two adjacent ratchet teeth 111$._A$ and 111$._B$, lower ratchet pawl 122$._B$ is between two adjacent ratchet teeth 111$._D$ and 111$._E$. So that ratchet wheel 110 will be locked at this control-position. As shown in FIG. 1A, ratchet teeth 111 (111$._A$, 111$._B$, 111$._C$, 111$._D$, 111$._E$, 111$._F$) and pawls 122 (122$._A$, 122$._B$) are circular-arc shape.

FIG. 1B shows said ratchet wheel 110 starting to be being turned from still (initial) position shown in FIG. 1A toward next control-position. As shown in FIG. 1B, when the operator turns the knob (not shown in the Figure) counterclockwise, which is disposed at one end of ratchet wheel 110, ratchet wheel 110 starts to turn counterclockwise resulted in ratchet tooth 111$._B$ also being turned. In this time, the circular-arc shape surface of ratchet tooth 111$._B$ will act an outward thrust on the circular-arc shape surface of pawl 122$._A$ at their contact place, then due to the elasticity of transversal pawl arm 121$._A$, upper pawl 122$._A$ moves outward and resulted in that an outward elastic bending deformation of transversal pawl arm 121$._A$ will occur along with the outward movement of upper pawl 122$._A$. Similarly, when the counterclockwise turning of ratchet wheel 110 causes ratchet tooth 111$._E$ to turn, the circular-arc shape surface of ratchet tooth 111$._E$ will act an outward thrust on the circular-arc shape surface of lower pawl 122$._B$ at their contact place, then due to the elasticity of transversal pawl arm 121$._B$, lower pawl 122$._B$ moves outward resulted in that an outward elastic bending deformation of transversal pawl arm 121$._B$ will occur along with the outward movement of lower pawl 122$._B$. As shown in FIG. 1B, for the interactions between both the circular-arc shape surfaces of upper pawl 122$._A$ and ratchet tooth 111$._B$ and between both the circular-arc shape surfaces of lower pawl 122$._B$ and ratchet tooth 111$._E$, so that when the top points of the circular-arc shape surfaces of upper pawl 122$._A$ and lower pawl 122$._B$ respectively approach to the top points of the circular-arc shape surfaces of ratchet tooth 111$._B$ and ratchet tooth 111$._E$, if knob is loosen by the operator (or the operator does not apply any force to knob), the resilient forces respectively produced by the elastic bending deformation of transversal pawl arm 121$._A$ and by that of arm 121$._B$ will compel ratchet tooth 111$._B$ and ratchet tooth 111$._E$ still to comeback to their respective original control-position. Namely, in this time the operator has to act force continuously to turn ratchet wheel 110 and cannot stop.

FIG. 1C is a schematic diagram of a typical ratchet wheel mechanism when a cam is turned just to hung-up point to show said ratchet wheel 110 at the position shown in FIG. 1D being turned continuously toward next control-position. At the position shown in FIG. 1B, the operator continuously turns ratchet wheel 110 counterclockwise, upper pawl 122$._A$ continuously moves outward to cause the elastic bending deformation of transversal pawl arm 121$._A$ continuously increasing, then the top point of circular-arc shape surface of upper pawl 122$._A$ coincides with the top point of circular-arc shape surface of ratchet tooth 111$._B$. Similarly, lower pawl 122$._B$ continuously moves outward to cause the elastic bending deformation of transversal pawl arm 121$._B$ continuously increasing along with the counterclockwise turning of ratchet wheel 110, then the top point of circular-arc shape surface of lower pawl 122$._B$ coincides with the top point of circular-arc shape surface of ratchet tooth 111$._E$. At this time, the outward elastic bending deformation of two transversal pawl arms 121 (121$._A$ and 121$._B$) increases to maximum. For the resilient forces respectively acted on the top point of the circular-arc shape surfaces of ratchet teeth 111$._B$ and 111$._E$ by the top point of the circular-arc shape surface of upper pawl 122$._A$ and by the top point of the circular-arc shape surface of lower pawl 122$._B$ just pass through the center of ratchet wheel 110, so they cannot yield turning moment for ratchet wheel 110. When the top points of the circular-arc shape surfaces of upper pawl 122$._A$ and lower pawl 122$._B$ respectively coincide with the top point of the circular-arc shape surface of ratchet tooth 111$._B$ and with that of ratchet tooth 111$._E$, if knob is loosen by the operator (or the operator does not apply any force to knob), ratchet wheel 110 will stop at this position and keep in equilibrium, notwithstanding this position is not the expected next control-position, i.e. ratchet wheel 110 keeps in equilibrium and stop at a wrong position. Such phenomenon means there exists a hung-up point between two adjacent switch control-positions, and then to cause the turning switch bringing control failure.

FIG. 1D is a schematic diagram of a typical ratchet wheel mechanism after a cam going over hung-up point to show said ratchet wheel 110 at the position shown in FIG. 1C continuously being turned toward next control-position. At the position shown in FIG. 1B, the operator continuously turns ratchet wheel 110 counterclockwise, transversal pawl arm 121.$_A$ starts to move inward, then to cause upper pawl 122.$_A$ moving toward next control-position. Similarly, transversal pawl arm 121.$_B$ also moves inward along with the counterclockwise turning of ratchet wheel 110, then to cause lower pawl 122.$_B$ moving toward next control-position. For the interactions between both the circular-arc shape surfaces of upper pawl 122.$_A$ and ratchet tooth 111.$_B$ and between both the circular-arc shape surfaces of lower pawl 122.$_B$ and ratchet tooth 111.$_E$, so that when the top points of the circular-arc shape surfaces of upper pawl 122.$_A$ and lower pawl 122.$_B$ respectively somewhat depart from the top points of the circular-arc shape surfaces of ratchet tooth 111.$_B$ and ratchet tooth 111.$_E$, even though in this time the force acted on the knob is decreased (or no force acted on the knob), the resilient force produced by the elastic deformation of transversal pawl arms 121.$_A$ and 121.$_B$ yet will help to push ratchet teeth 111.$_B$ and 111.$_E$ (or push teeth 111.$_B$ and 111.$_E$ directly by resilient force itself) to next control-position, i.e. ratchet wheel 110 may be turned through a smaller force acted by the operator (or the operator does not act any force).

FIG. 1E is a schematic diagram of a typical ratchet wheel mechanism when a cam turning 60° to show said ratchet wheel 110 at the position shown in FIG. 1E continuously being turned to achieve next control-position. As shown in FIG. 1E, ratchet wheel 110 and pawl device 120 are matched each other at the next control-position. Saying concretely, at this control-position upper pawl 122.$_A$ is between ratchet teeth 111.$_B$ and 111.$_C$; lower pawl 122.$_B$ is between ratchet teeth 111.$_E$ and 111.$_F$. So that ratchet wheel is locked at the next control-position.

The ratchet wheel mechanism introduced above has following shortcomings: (1) Ratchet wheel may stop at a hung-up point between two adjacent switch control-positions, then to cause control failure occurring for the turning switch, the phenomenon of hung-up point especially is able to occur, if a large angle is included between two adjacent ratchet teeth (such as not less than 60°). (2) The ratchet wheel mechanism, introduced above, has a low working efficiency, for the frictional force existing among the contact surfaces of ratchet teeth of ratchet wheel and pawls. (3) More larger turning moment is needed for the turning switch having more loops to control, hand handle in operation also is not comfortable; Furthermore, the applied force is uneven and the operation is unsteady due to the interference of interior electricity-conductive contact spring of the turning switch.

BRIEF DESCRIPTION OF THE INVENTION

Aiming to solving above problem, the object of the present invention is to provide a ratchet wheel mechanism, wherein comprising:

Camshaft circular disc, on the fore end surface of said camshaft circular disc is disposed at least one groove, on the rim of said camshaft circular disc are disposed several positioning slots;

Driving cam, on the end surface of said driving cam is disposed at least one groove corresponding to that on the front surface of said camshaft circular disc, on the rim of driving cam are disposed several angular shape teeth;

First pawl and second pawl;

After the fore end surface of said camshaft circular disc and the end surface of driving cam are gathered together face to face, the groove(s) on camshaft circular disc and the groove(s) on driving cam will form at least one empty chamber in which at least one resilient element is placed;

When said camshaft circular disc is at a control-position, first pawl falls into a positioning slot to lock said camshaft circular disc at this control-position;

When said driving cam starts to be being turned toward next control-position, said camshaft circular disc keeps at its position not varying, thus the groove on camshaft circular disc and the groove on said driving cam are staggered each other to compress the resilient element to store resilient potential energy therein;

When said camshaft circular disc is turned to the next control-position, one angular shape tooth pushes said first pawl out from one positioning slot, resilient element pushes camshaft circular disc to turn to the next control-position, second pawl falls into another positioning slot of said camshaft circular disc to lock said camshaft circular disc at the next control-position.

The present invention also provides a turning switch with aforesaid ratchet wheel mechanism as said above.

In present invention, the implementation of switchover to cause the turning switch from current control-position to next control-position may be carried out through user to turn driving cam by knob. When driving cam starts to be turned, camshaft circular disc keeps in its position not turning for one positioning slot of camshaft circular disc is locked by one pawl, thus interior spring is compressed to store resilient potential energy. When driving cam is turned a predetermined angle counterclockwise, one pawl will be pushed out from one positioning slot by one angular shape tooth of driving cam, and then the resilient potential energy will be released from interior spring to push camshaft circular disc turning a predetermined angle counterclockwise; thus another pawl will fall into another positioning slot to send out a snap, the knob also will cause user to feel a jumpiness. Additionally, because the user only acts force to compress interior spring before driving cam starts to be turned, and then driving cam is pushed to turn by interior spring, so that in turning operation of driving cam, the acted force is even, the operation is steady, user feels a comfortable hand handle, the phenomenon of hung-up point between two adjacent control-positions also may be avoided.

DETAILED DESCRIPTION OF THE INVENTION

Figure 1A:
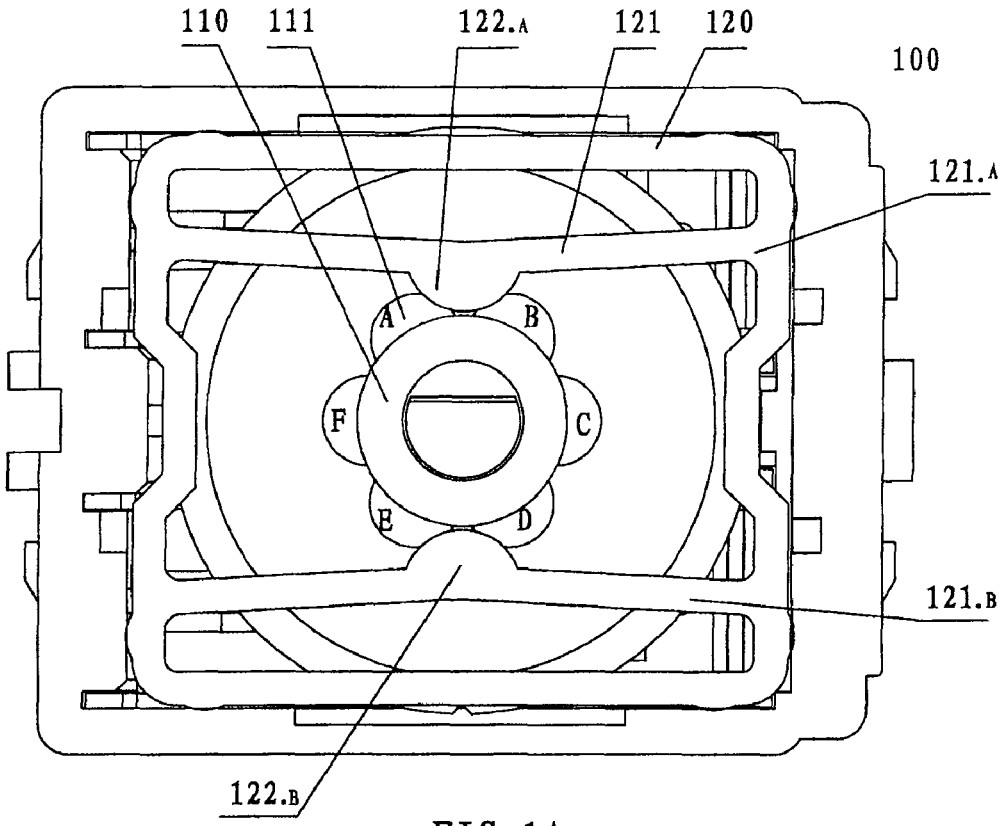
FIG. 1A shows said ratchet wheel mechanism 100 at still (initial) position.
Figure 1B:
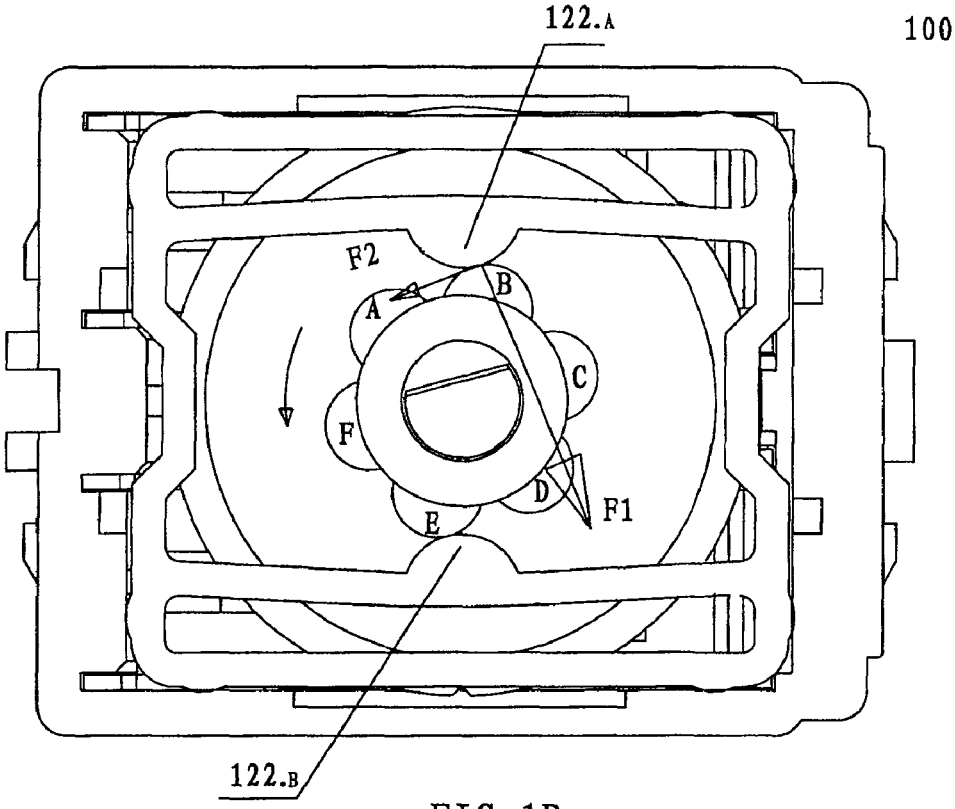
FIG. 1B shows said ratchet wheel 110 starting to be turned from still (initial) position toward next control-position.
Figure 1C:
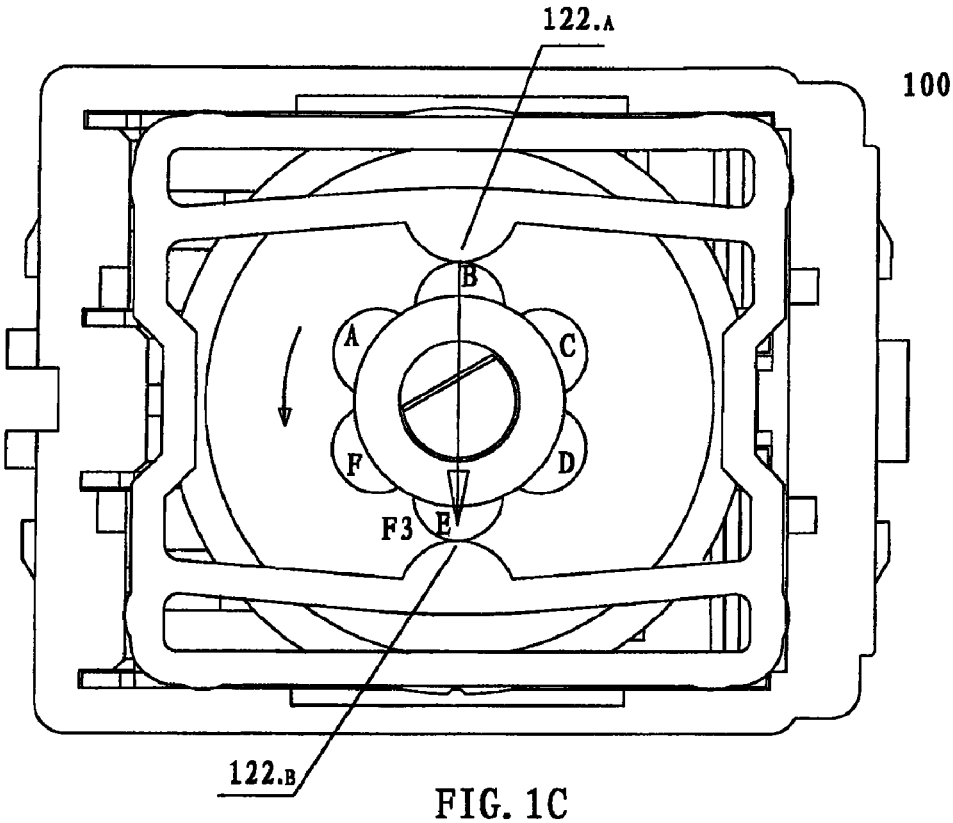
FIG. 1C is a schematic diagram of a typical ratchet wheel mechanism when a cam is turned just to hung-up point.
Figure 1D:
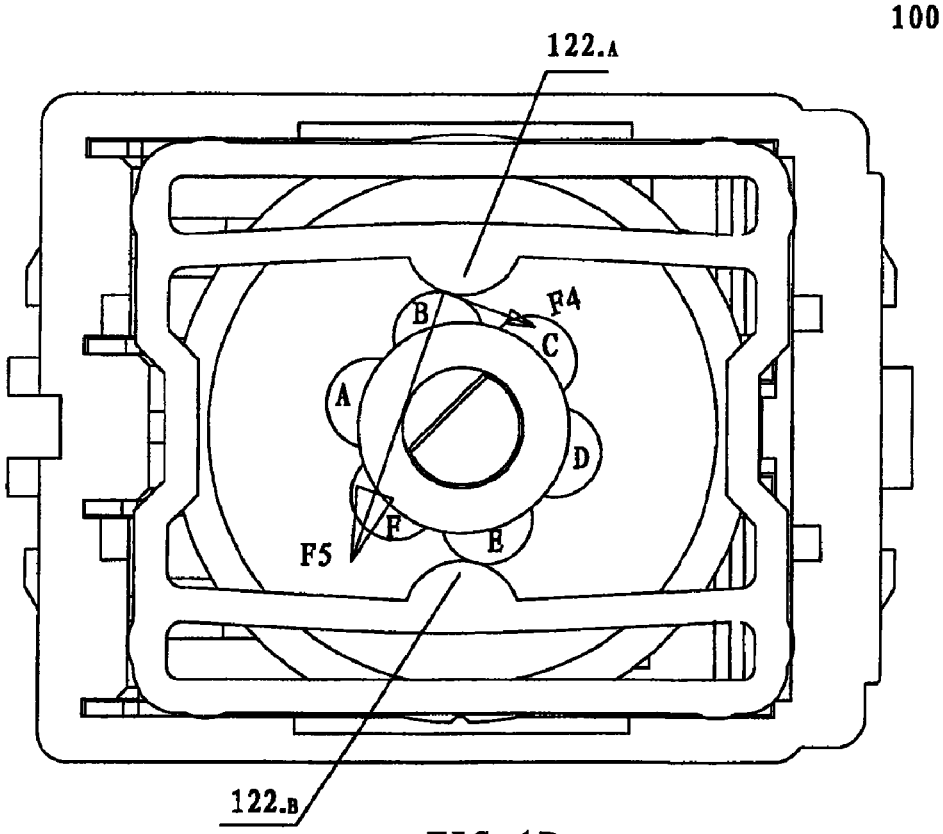
FIG. 1D is a schematic diagram of a typical ratchet wheel mechanism after a cam going over hung-up point
Figure 1E:
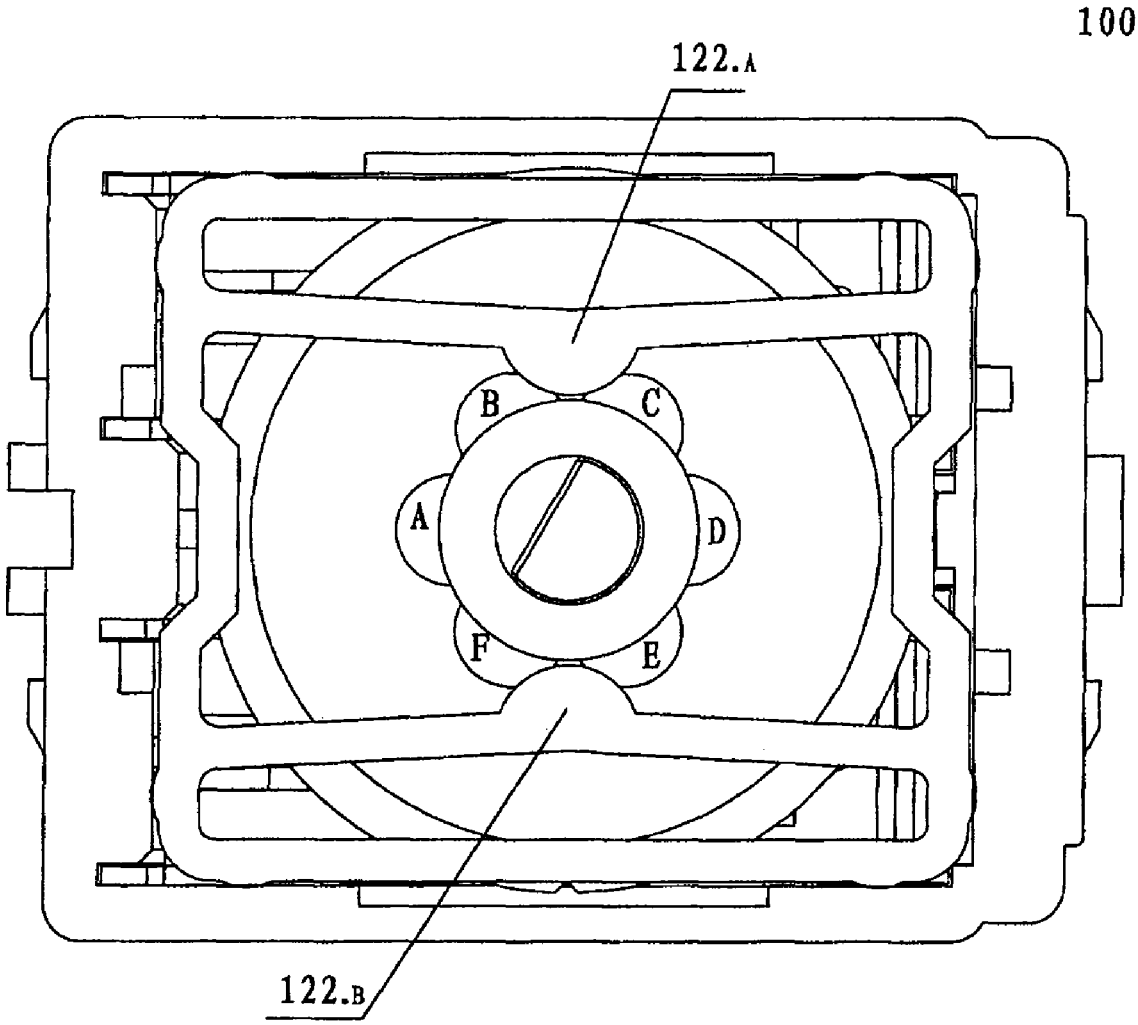
FIG. 1E is a schematic diagram of a typical ratchet wheel mechanism when a cam turning 60° counterclockwise.

The meanings of element (or component) reference numbers used in the drawings of the present invention are as follows:

Ratchet wheel mechanism 100: ratchet wheel 100, ratchet teeth 111, pawl devices 120, transversal pawl arms 121 and pawls 122;

Ratchet wheel mechanism 200: camshaft mechanism 201, executive mechanism 202, circular ring 205 for assembling knob, executive circular disc 206, circular prominence 207, driving cam 208, sector shape groove 211, positioning slot 212, interior spring 213, camshaft 215, camshaft circular disc 220 (its function is equivalent to aforesaid ratchet wheel 110 co-axial with camshaft), sector shape groove 222, empty chamber 231, angular shape teeth 235, upper pawl device 250, exterior spring 251, pawl arm 252, pins 253 and 254, upper pawl 255, lower pawl device 260, exterior spring 261, pawl arm 262, pins 263 and 264, lower pawl 265;

Turning switch 300: housing 301, switch contact sheets 302, upper housing 311, lower housing 312, grooves 321 and 322, electricity-conductive plates 341 and 342, electricity-conductive contactors 343 and 344, electricity-conductive bridge 345, springs 346 and 347, electricity-conductive plates 351 and 352, electricity-conductive contactors 353 and 354, electricity-conductive bridge 355, springs 356 and 357.

Associating with the drawings below is carried out a further description of the present invention.

Figure 2A:
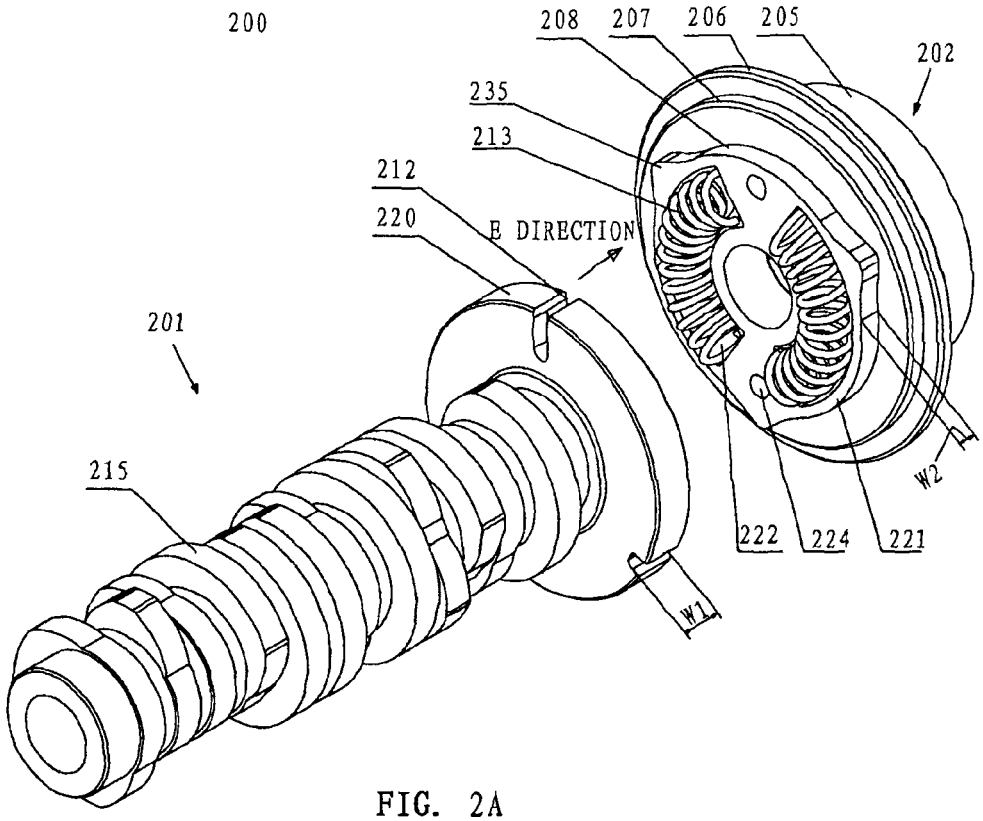
FIG. 2A is a perspective view of components: camshaft mechanism 201 and executive mechanism 202 of step type ratchet wheel mechanism 200 of the present invention.

FIG. 2A is a perspective view of components: camshaft mechanism 201 and executive mechanism 202 of step type ratchet wheel mechanism 200 of the present invention. As shown in FIG. 2A, step type camshaft mechanism 200 of the present invention comprises: camshaft mechanism 201 and executive mechanism 202.The components of camshaft mechanism 200 in FIG. 2A are viewed from rear end of camshaft mechanism 201 (or viewed from fore end of executive mechanism 202), i.e. viewed along direction indicated as arrowhead E. Camshaft mechanism 201 comprises camshaft 215, on and along which are disposed a plurality of cams (12 cams shown in the Figure) used to control the connection and disconnection mechanism of a plurality of switch contact sheets 302 (12 groups of switch contact sheets, see FIG. 3A). Camshaft mechanism 201 has a camshaft circular disc 220 (driven disc) with thickness We. On the rim of camshaft circular disc are evenly distributed 3 positioning slots (positioning slots $\mathbf{212}._A$, $\mathbf{212}._B$ and $\mathbf{212}._C$, taking 120° as angular spacing). Camshaft 215 (driven shaft) is connected with the rear surface of camshaft circular disc 220.

As shown in FIG. 2A, executive mechanism 202 comprises: an executive circular disc 206 (driving disc), on the rear surface of executive circular disc 206 is jointed a circular ring 205 used for assembling the knob of turning switch (not shown in the Figure). On the fore surface of executive circular disc 206 exists a circular prominence 207; on circular prominence 207 exists a protruded driving cam 208 (with thickness $W_2$). The radius of inner root circle of driving cam 208 is $R_1$; the radius of outer top circle of driving cam 208 is $R_2$. On the rim of inner root circle are evenly distributed 3 angular shape teeth (angular shape teeth $\mathbf{235}._A$, $\mathbf{235}._B$ and $\mathbf{235}._C$ taking 120° as angular spacing). On driving cam 208 are symmetrically arranged two sector shape grooves having a semicircular section. These two symmetrical sector shape grooves are used respectively to contain a resilient element. The resilient element preferably is spring, it may be called as interior spring 213. In diametrical direction, half of interior spring 213 is just put into sector shape groove 222, another half of interior spring 213 is just put into sector shape groove 221 arranged on camshaft circular disc 220 (see FIG. 2B). Sector shape groove 222 and sector shape groove 221 are gathered together to form an empty chamber used to contain entire interior spring 213 (see FIG. 2G).

Figure 2B:
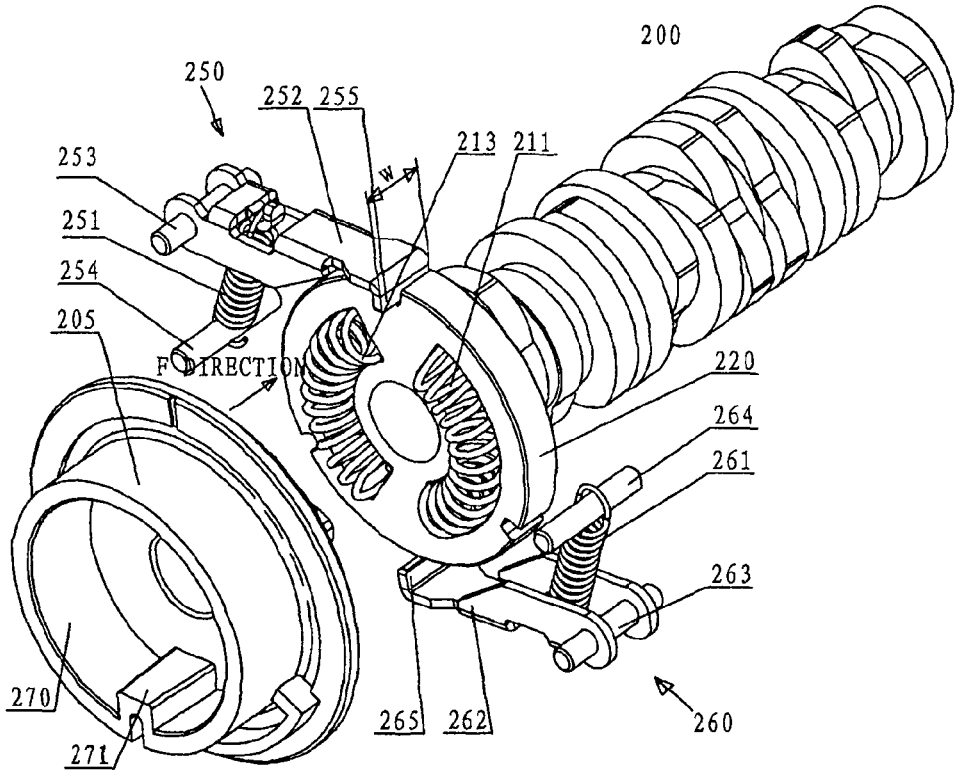
FIG. 2B is an assembly perspective view of components: camshaft mechanism 201 and executive mechanism 202 of step type ratchet wheel mechanism 200 of the present invention.

FIG. 2B is an assembly perspective view of components: camshaft mechanism 201, executive mechanism 202 and pawl devices (250 and 260) of step type ratchet wheel mechanism 200 of the present invention. As shown in FIG. 2B, the components of ratchet wheel mechanism 200 are viewed along a direction from fore end of camshaft mechanism 201 (or from rear end of executive mechanism 202) (along direction indicated as arrowhead F). As shown in FIG. 2B, on the fore-end surface of camshaft circular disc 220 are symmetrically arranged two sector shape grooves 211 with semicircular section. These two symmetrical sector shape grooves 211 are respectively used to contain the interior springs 213. In diametrical direction, half of interior spring 213 is just put into sector shape groove 211; another half of interior spring 213 is just put into sector shape groove 222 arranged on driving cam 208 (see FIG. 2A). Sector shape groove 222 and sector shape groove 221 are gathered together to form an empty chamber used to contain entire interior spring 213 (see FIG. 2G).

In FIG. 2B, ratchet mechanism 200 further comprises: two pawl devices, i.e. upper pawl device 250 and lower pawl device 260. Upper pawl device 250 includes: exterior spring 251, pawl arm 252, pins 253 and 254; lower pawl device 260 includes: exterior spring 261, pawl arm 262, pins 263 and 264. The bent downward portions at the fore ends of pawl arms 252 and 262 respectively are pawl 255 and pawl 265 (see FIG. 2D); the thickness of pawl 255 and pawl 265 is suitable for inserting the pawl into positioning slot 212 of camshaft circular disc 220. The width W of pawls 255 and 265 is larger than the thickness $W_1$ of camshaft circular disc 220, so that in width direction of pawl 255 or 265 still exists residual portion after pawl 255 or 265 falls into positioning slot 212, this residual portion will rest on the rim of driving cam 208. Namely, when camshaft circular disc 220 and driving cam 208 are assembled together face to face, pawl 255 (or pawl 265) may rest on the rim of camshaft circular disc 220 (or fall into positioning slot of camshaft circular disc 220) and simultaneously rest on the rim of driving cam 208.In FIG. 2B, in circular ring 205 for assembling knob exists an assembling hole 270 and a fixed key 271, assembling hole 270 and fixed key 271 are used to assemble knob of turning switch (not shown in Figure).

Figure 2C:
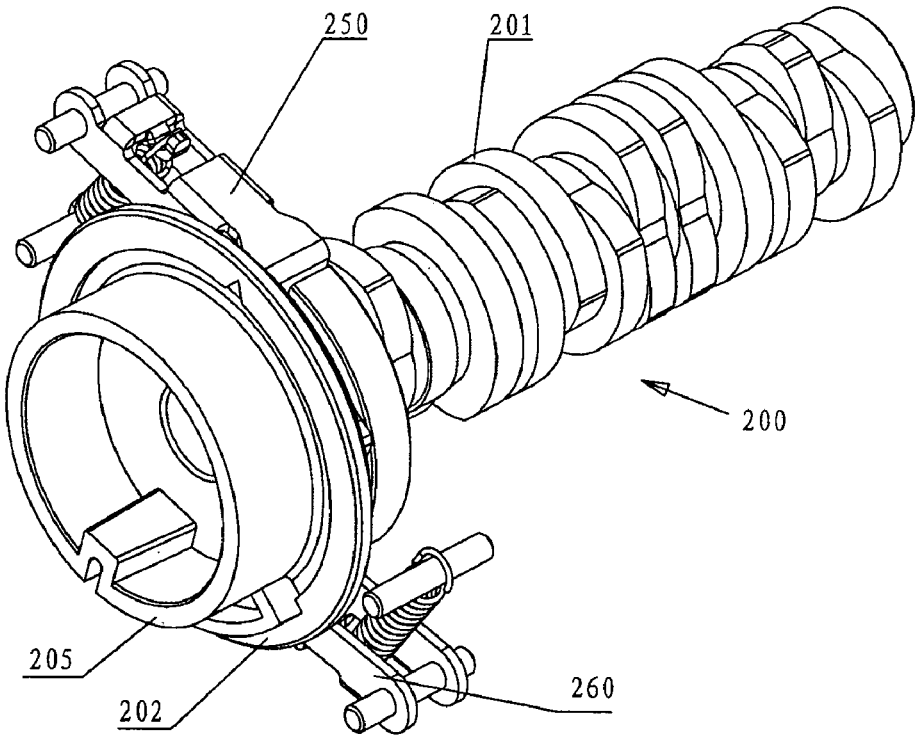
FIG. 2C is an assembly perspective view of camshaft 201, executive mechanism 202 and pawl devices (250 and 260) in step type ratchet wheel mechanism 200.

FIG. 2C is an assembly perspective view of camshaft 201, executive mechanism 202 and pawl devices (250 and 260) in step type ratchet wheel mechanism 200. As shown in FIG. 2C, camshaft mechanism 201, executive mechanism 202 and pawl devices (250 and 260) already were assembled together. In this time, camshaft circular disc 220 of camshaft mechanism 201 and driving cam 208 of executive mechanism 202 are assembled together face to face, and to cause two sector shape grooves 211 on the end surface of camshaft circular disc 220 and two sector shape grooves 222 on the end surface of driving cam 208 able to be correspondingly gathered together to form two empty chambers 231 for containing their respective interior spring 213 (as shown in State 1 of FIG. 2G). Furthermore, for the width W of pawl 255 and pawl 265 is approximately equal to the sum of thickness $W_1$ of camshaft circular disc 220 and thickness $W_2$ of driving cam 208, thus pawl (255 or 265) may rest on the rim of camshaft circular disc 220 (or fall into positioning slot 212 of camshaft circular disc 220) and simultaneously rest on the rim of driving cam 208.

Figure 2D:
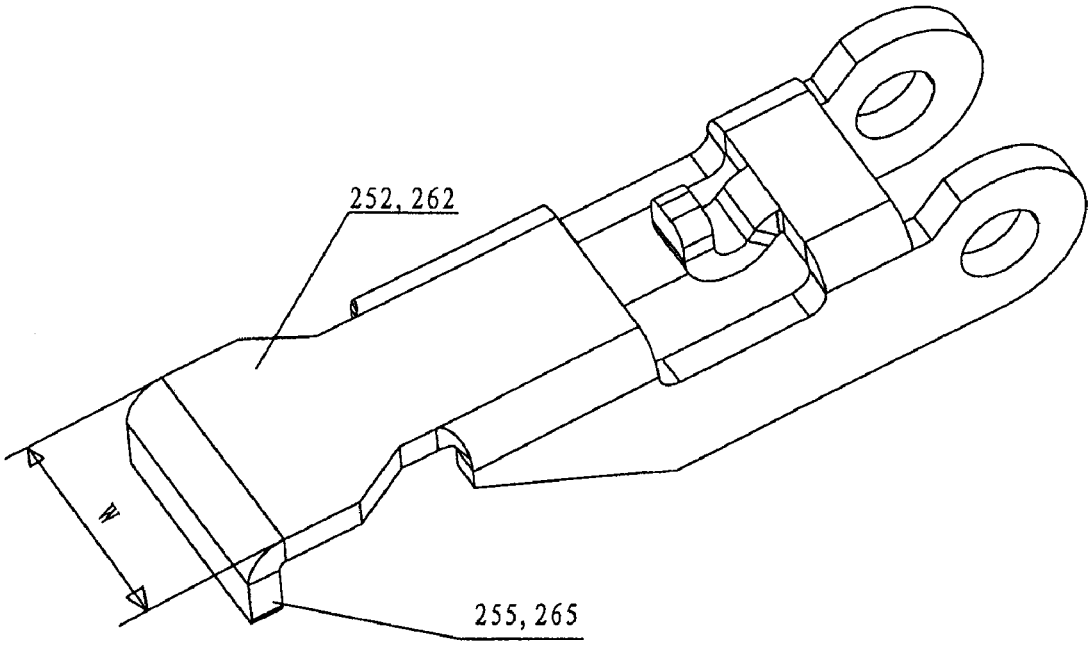
FIG. 2D is a schematic diagram of pawl arm of the present invention.

FIG. 2D is a schematic diagram of pawl arm of the present invention. The bent downward portions at the fore ends of pawl arms 252 and 262 respectively form pawl 255 and pawl 265. The width of pawls 255 and 265 is W.

Figure 2E:
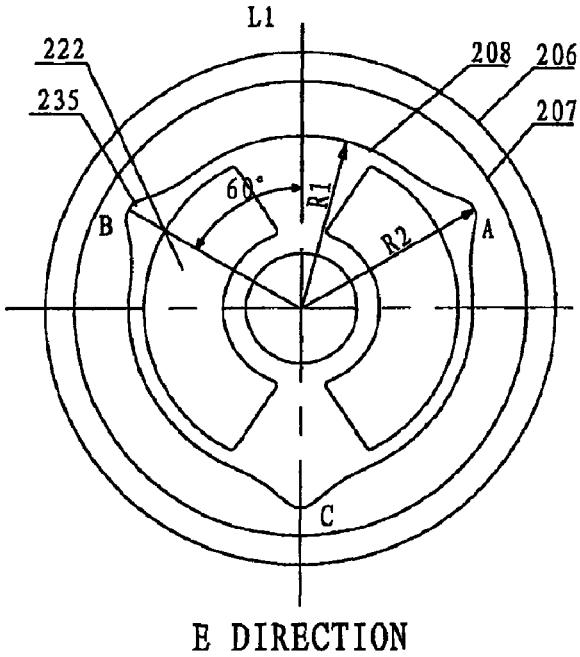
FIG. 2E is an elevation of executive mechanism 202 viewed from E direction.
Figure 2F:
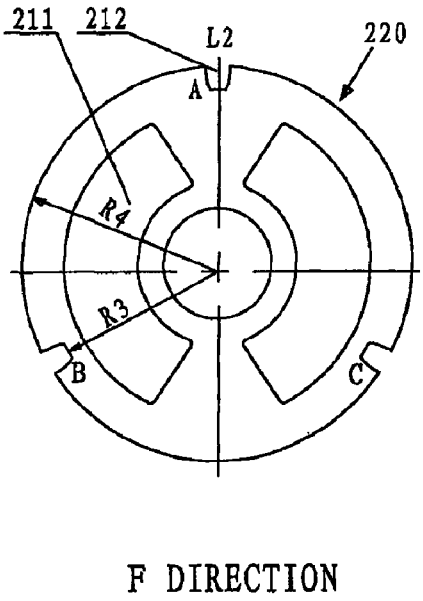
FIG. 2F is an elevation of camshaft circular disc 220 viewed from F direction.

FIG. 2E is an elevation of executive mechanism 202 viewed along a direction indicated as arrowhead E. FIG. 2F is an elevation of camshaft circular disc 220 viewed along a direction indicated as arrowhead F. As shown in FIG. 2E, the radius of inner root circle of driving cam 208 is denoted as $R_1$, radius of outer top circle of driving cam 208 as $R_2$, and the top points of 3 angular shape teeth 235.$_A$, 235.$_B$ and 235.$_C$ inscribe in the outer top circle of driving cam 208. As shown in FIG. 2F, the distance from the bottom of positioning slot 212 of camshaft circular disc 220 to the center of camshaft circular disc 220 is denoted as $R_3$, the radius of camshaft circular disc 220 as $R_4$. Following relation exists among $R_1$, $R_2$, $R_3$ and $R_4$: the radius $R_1$ of inner root circle of driving cam 208 is equal (or approximately equal) to the distance $R_3$ from the bottom of positioning slot 212 of camshaft circular disc 220 to the center of camshaft circular disc 220; the radius $R_2$ of outer top circle of driving cam 208 is equal to (or slightly larger than) radius $R_4$ of camshaft circular disc 220. Obviously, radius $R_2$ of outer top circle of driving cam 208 is larger than radius $R_1$ of inner root circle of driving cam 208; radius $R_4$ of camshaft circular disc 220 is larger than the distance $R_3$ from the bottom of positioning slot 212 of camshaft circular disc 220 to the center of camshaft circular disc 220; radius $R_4$ of camshaft circular disc 220 is larger than radius $R_1$ of inner root circle of driving cam 208. As shown in FIG. 2E, the symmetrical axis of two sector shape groves 222 on driving cam 208 is denoted as L1, the angle included between L1 and line passing through the top point of angular shape tooth 235.$_B$ and the center of camshaft is 60°. As shown in FIG. 2F, the symmetrical axis of two sector shape groves 211 on camshaft circular disc 220 is denoted as L2, L2 also is the symmetrical axis of positioning slot 212.$_A$. Thus when sector shape groove 222 coincides with sector shape groove 211, namely L1 coincides with L2, the angle included between angular shape tooth 235.$_A$ and positioning slot 212.$_A$ is about 60° (step angle is 60°).

Figure 2G:
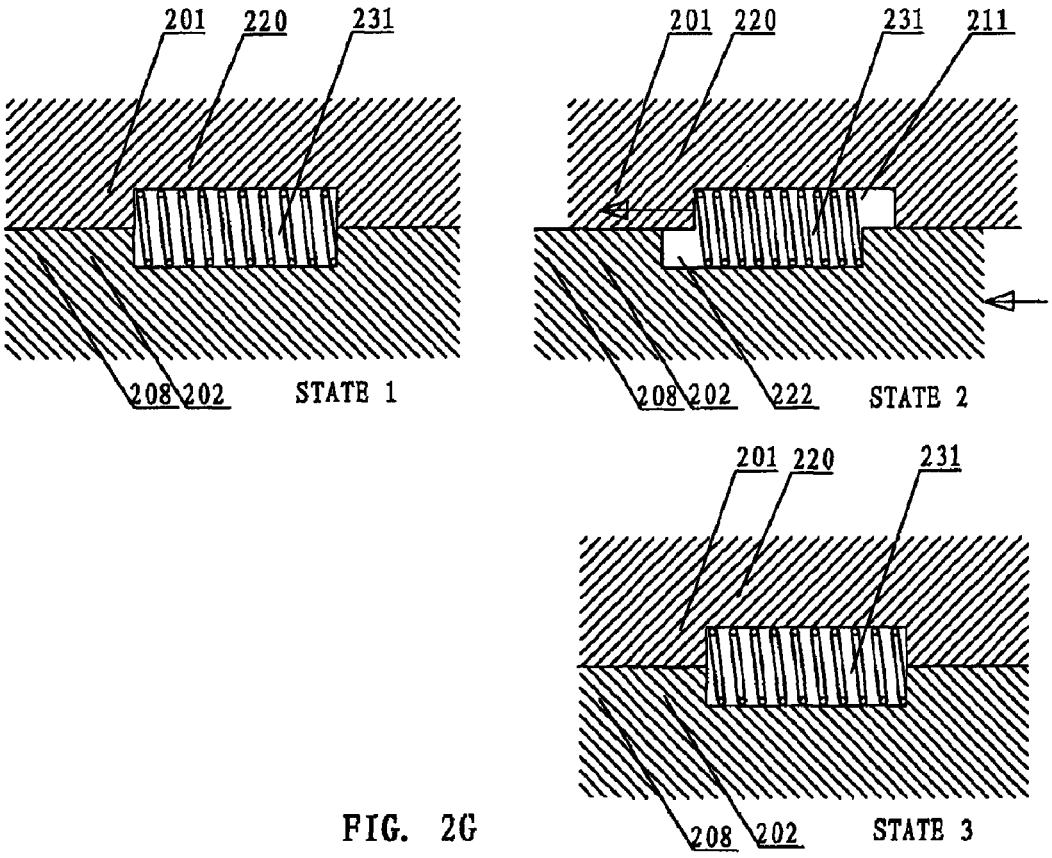
FIG. 2G is a partial sectional view of camshaft circular disc 220 and driving cam 208 of the present invention, when they are assembled together.

FIG. 2G is a partial sectional view of camshaft circular disc 220 and driving cam 208 of the present invention, which are assembled together. When executive mechanism 202 and camshaft mechanism 201 are assembled together (see FIG. 2C), sector shape groove 211 on camshaft circular disc 220 and sector shape groove 222 on driving cam 208 are gathered together to form empty chamber 231 for containing interior spring 213 (as shown in State 1). In sate 1, interior spring is in free state, i.e. not compressed; or for working reliably, interior spring 213 may be somewhat pre-compressed.

In State 2, driving cam 208 is turned counterclockwise, but camshaft circular disc 220 keeps in still state (because pawl 255 or 265 is inserted in positioning slot 212 on camshaft circular disc 220), thus sector shape groove 211 and sector shape groove 222 are staggered each other resulted in that interior spring 213 is compressed and resilient potential energy is stored in interior spring. In this time, the force acted by interior spring 213 (as shown in Figure its direction is to the left) will form a counterclockwise moment for camshaft circular disc 220.

Figure 4A:
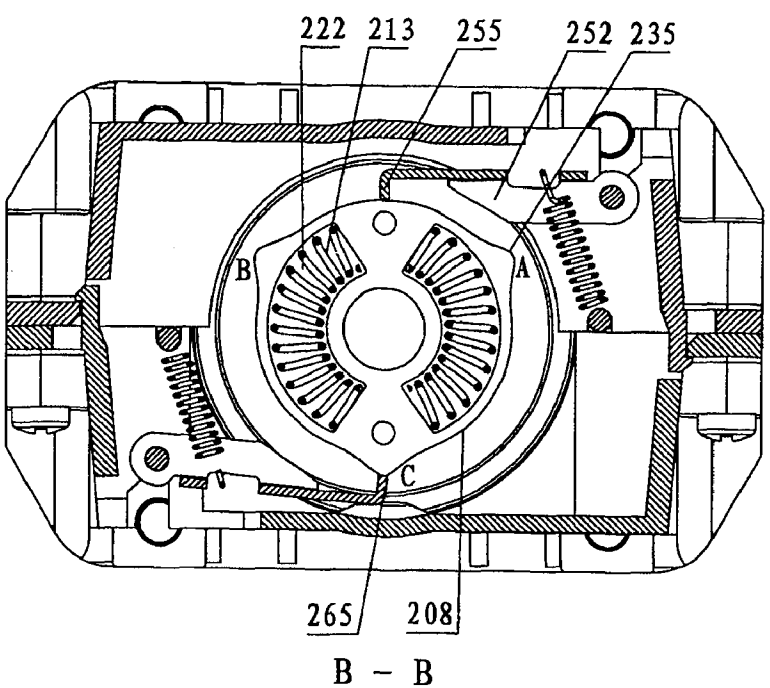
FIG. 4A shows the circumstance of relative position between camshaft circular disc 200 and driving cam 208, when turning switch is at initial position.
Figure 4A:
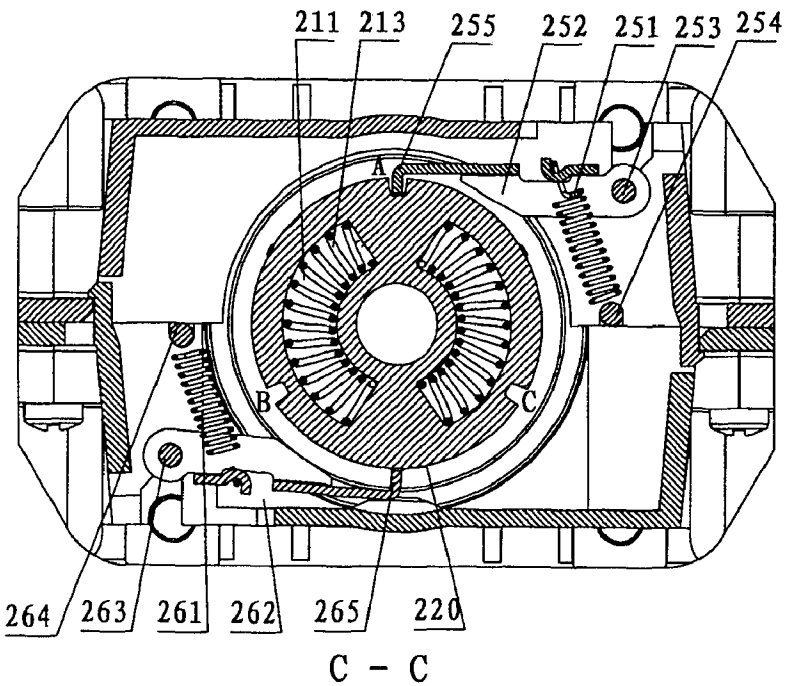
Figure 4B:
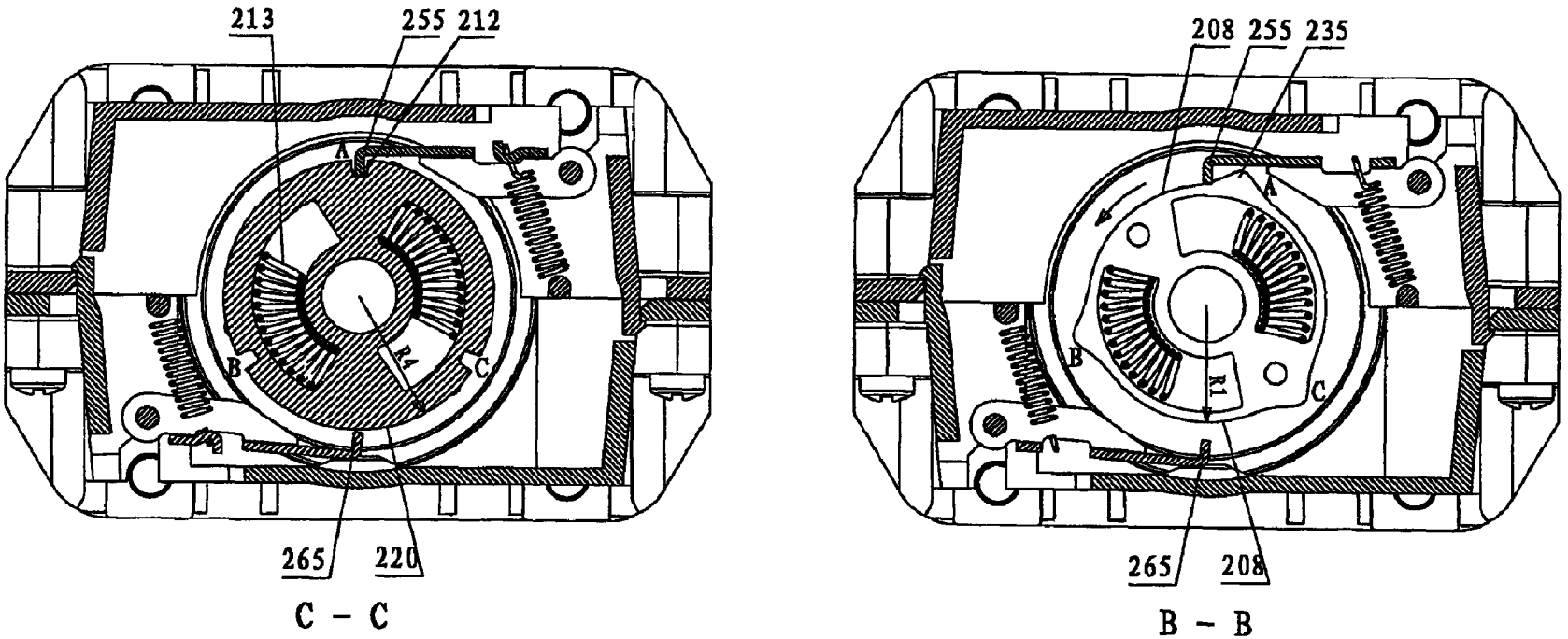
FIG. 4B shows the circumstance of relative position between camshaft circular disc 200 and driving cam 208, after driving cam 208 is turned an angle counterclockwise.
Figure 4C:
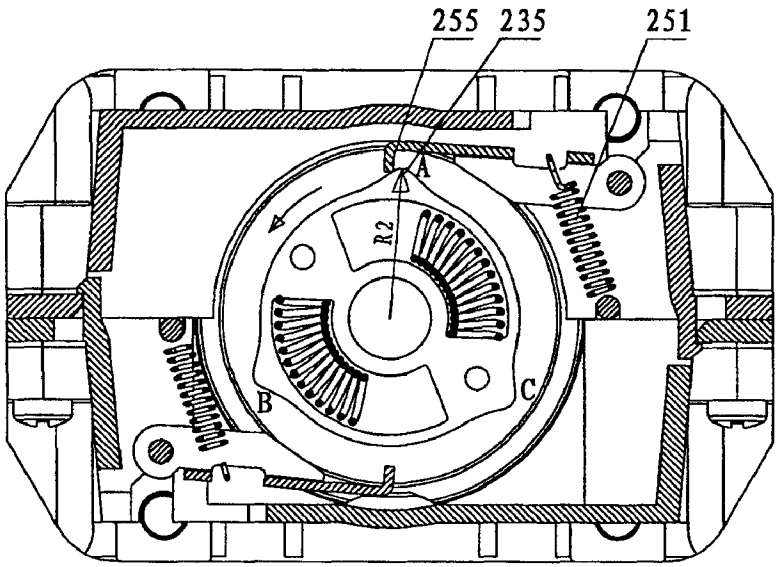
FIG. 4C shows the circumstance of relative position between camshaft circular disc 200 and driving cam 208, after driving cam 208 is continuously turned an angle counterclockwise.
Figure 4C:
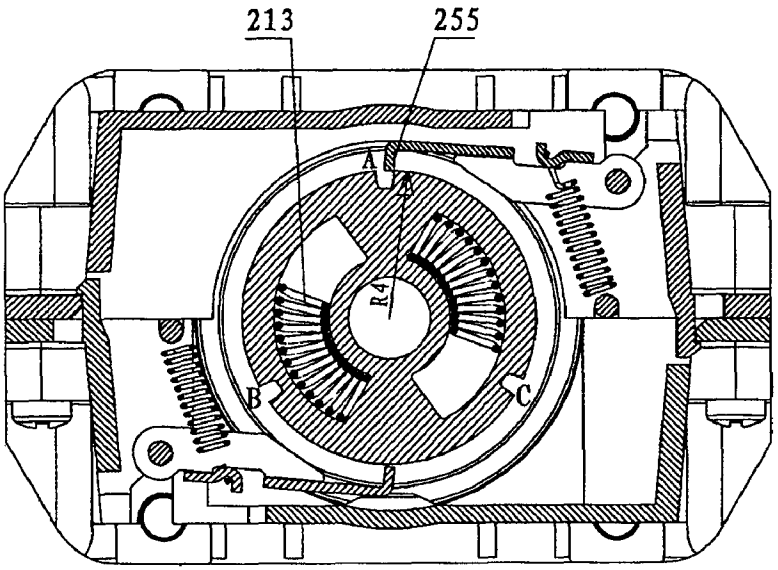
Figure 4D:
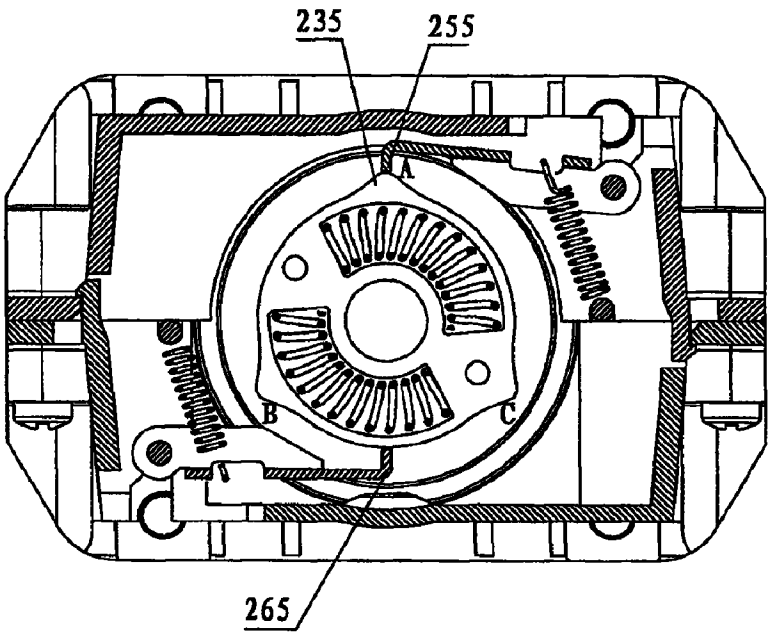
FIG. 4D shows the circumstance of relative position between camshaft circular disc 200 and driving cam 208, when driving cam 208 is continuously turned to 60° counterclockwise.
Figure 4D:
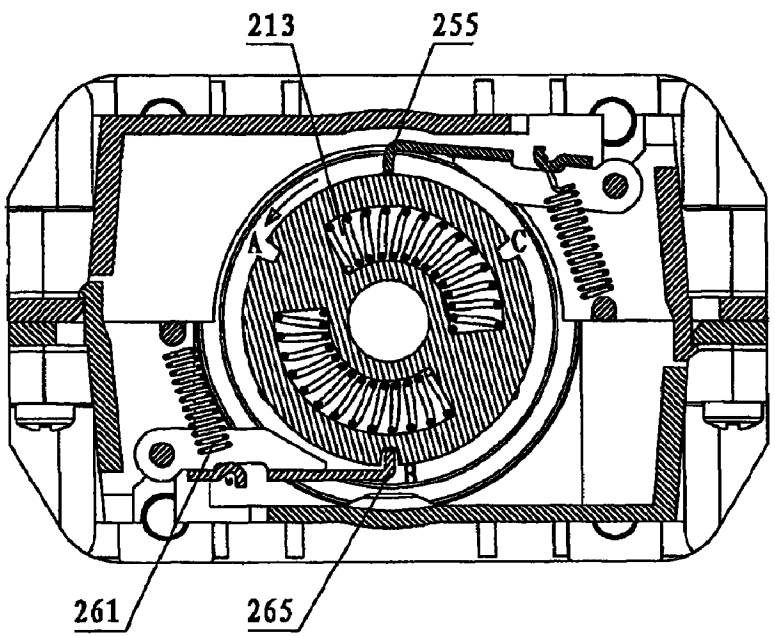

In State 3, when driving cam 208 is turned to 60° counterclockwise, Pawl 255 (or pawl 265) is pushed out from positioning slot 212 on camshaft circular disc 220, then the resilient potential energy stored in interior spring 213 is released to cause camshaft circular disc being turned 60° counterclockwise resulted in that sector shape groove 211 on camshaft circular disc 220 and sector shape groove 222 on driving cam 208 are gathered together over again, then to form an entire empty chamber 231 as shown in State 1 (the detailed operational process, see the description about FIG. 4A and FIG. 4D).

Figure 3A:
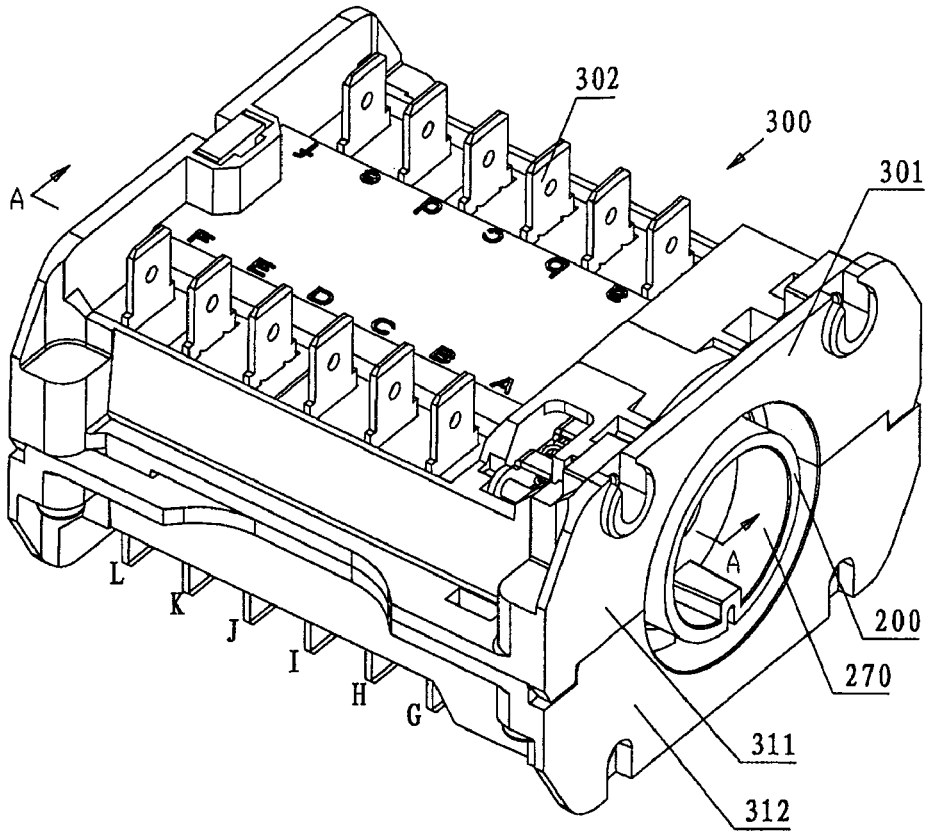
FIG. 3A is a perspective view of turning switch 300 of the present invention.

FIG. 3A is a perspective view of turning switch 300 of the present invention. Turning switch 300 has a housing 301 composed of upper housing 311 and lower housing 312. Ratchet wheel mechanism 200 shown in FIG. 2C (comprising camshaft mechanism 201, executive mechanism 202, and pawl devices 250 and 260) is assembled between upper housing 311 and lower housing 312. On upper housing 311 and on lower housing 312 are respectively disposed 6 groups (12 pieces) of switch contact sheets 302, (i.e. in a total of 12 groups, 24 pieces of switch contact sheets). Under the control of a relevant cam, each group of switch contact sheets may be electrically connected or disconnected, for example, switch contact sheets 302.*a* and 302. A form one group, switch contact sheets 302.*g* and 302.G form another one group.

Figure 3B:
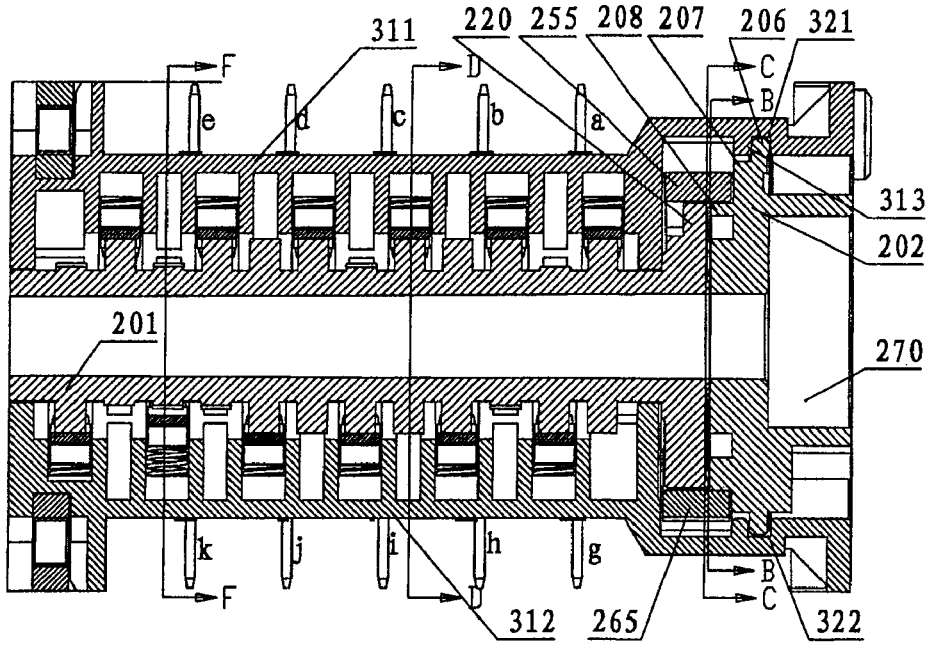
FIG. 3B is a sectional view of turning switch of the present invention along line A-A in FIG. 3A.

FIG. 3B is a sectional view of turning switch of the present invention along line A-A in FIG. 3A. As shown in FIG. 3B, ratchet mechanism 200 (comprising camshaft mechanism 201, executive mechanism 202, and pawl devices 250 and 260) is assembled and installed between upper housing 311 and lower housing 312 of turning switch. When assembling and installing, camshaft mechanism 201, executive mechanism 202, and pawl devices 250 and 260 are firstly assembled together (see FIG. 2C), then upper housing 311 and lower housing 312 are gathered together, thus camshaft mechanism 201, executive mechanism 202, and pawl devices 250 and 260 may be installed and fixed in the housing 301 of turning switch. Executive mechanism 202 is assembled in the fore portion of housing 301 of turning switch; camshaft mechanism 201 passes through the middle and the rear portion of housing 301 of turning switch.

On upper housing 311 and on lower housing 312 respectively exists semicircular groove 321 and semicircular groove 322. When semicircular groove 321 and semicircular groove 322 are gathered together, a space will be formed just to contain executive circular disc 206 on executive mechanism 202; groove wall 313 and circular prominence 207 are arranged face to face. The fit clearance between housing 301 (i.e. upper housing 311 and lower housing 312) and camshaft mechanism 201 and the fit clearance between housing 301 (i.e. upper housing 311 and lower housing 312) and executive mechanism 202 have to meet the requirement allowing camshaft mechanism 201 and executive mechanism 202 able to turn successfully in housing 301. When camshaft 215 is turned, the cams disposed on the camshaft may control the connection and disconnection mechanism of said 12 groups of switch contact sheets 302. When executive mechanism 202 is turned, camshaft mechanism 201 may be driven to turn by the resilient force of interior spring 213. Because the width W of upper pawl 255 and lower pawl 265 is equal or approximately equal to the sum of thickness $W_1$ of camshaft circular disc 220 and thickness $W_2$ of driving cam 208, so that upper pawl 255 and lower pawl 265 may rest on the rim of driving cam 208 and simultaneously rest on the rim of camshaft circular disc 220 (or fall into positioning slot 212 of camshaft circular disc 220).

Figure 3C:
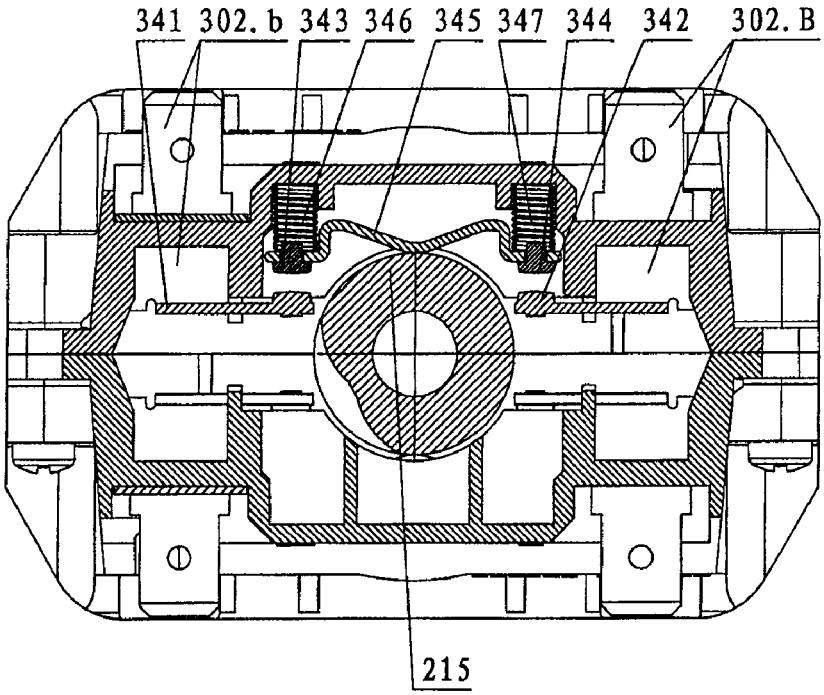
FIG. 3C is two sectional views of turning switch of the present invention along lines D-D and F-F in FIG. 3A.
Figure 3C:
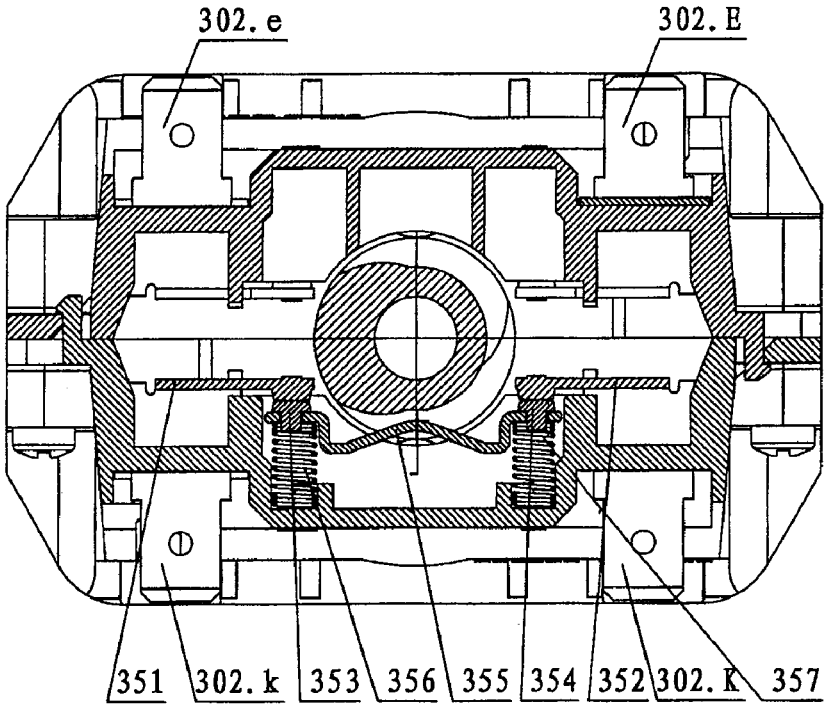

FIG. 3C are two sectional views of turning switch of the present invention along lines D-D and F-F in FIG. 3A, used to show the control mechanism of switch contact sheets. Through taking these two sectional views as examples, the working principle about how to control the connection and disconnection of two corresponding groups of switch contact sheets by two cams on camshaft is described. For other cams to control the connection and disconnection of other corresponding groups of switch contact sheets, the working principle just described above also is valid.

As shown in FIG. 3C, in control mechanism of switch contact sheets is disposed an electricity-conductive bridge 345 (355), on which exists a bow-shape protruded portion, so that in a period during a cam is turned 360°, a portion of the cam may push the bow-shape protruded portion of electricity-conductive bridge 345 (355) in a certain angular range, and other portion of the cam may depart from the bow-shape protruded portion of electricity-conductive bridge 345 (355) in other angular range. Two electricity-conduct contactors 343 and 344 (353 and 354) are respectively disposed at one end of electricity-conductive bridge 345 (355), two springs 346 and 347 (356 and 357) are disposed respectively at the back of each electricity-conduct contactors and installed on housing. Two electricity-conductive plates 341 and 342 (351 and 352), which are connected respectively with two pieces (a group) of switch contact sheets, are respectively disposed beneath one of electricity-conduct contactors 343 and 344 (353 and 354). Therefore, when the cam does not contact the bow-shape protruded portion of electricity-conductive bridge 345 (355), the resilient force of springs 346 and 347 (356 and 357) will press electricity-conductive contactors 343 and 344 (353 and 354) tightly against electricity-conductive plates 341 and 342 (351 and 352), so that an open circuit of electric appliance, which is across said electricity-conductive contactors, will be electrically connected to become a closed circuit. When the cam pushes the bow-shape protruded portion of electricity-conductive bridge 345 (355), the thrust of the cam may conquer the resilient force of springs 346 and 347 (356 and 357) to cause electricity-conductive contactors 343 and 344 (353 and 354) departing respectively from electricity-conductive plates 341 and 342 (351 and 352), so that a closed circuit of electric appliance, which is across said electricity-conductive contactors, will be electrically disconnected to become an opened circuit.

Here, the housing and the cams are insulators; electricity-conducive plates, electricity-conductive contactors and electricity-conductive bridges all are conductors.

As shown in F-F section, switch contact sheets 302.*k* and 302.K in lower housing are in electricity-connection state. The current flows in turn through switch contact sheet 302.*k*, electricity-conducive plate 351, electricity-conductive contactor 353, electricity-conductive bridge 355, electricity-conductive contactor 354, electricity-conducive plate 352, and finally to switch contact sheet 302.K. In this time, from F-F section it may be seen that a cam on camshaft 215 does not contact with electricity-conductive bridge 355, between them exists a gap. Through electricity-conductive contactors 353 and 354, springs 356 and 357 may press two ends of electricity-conductive bridge 355 respectively tightly against electricity-conductive plates 351 and 352, so that an electric connection is set up between contact sheets 302.*k* and 302.K.

As shown in D-D section, switch contact sheets 302.*b* and 302.B in upper housing are in electric-disconnection state. Because in uplifting process of electricity-conductive bridge 345 due to a cam on camshaft 215 pushing electricity-conductive bridge 345 upward, springs 346 and 347 are compressed. In this time, electricity-conductive contactors 343 and 344 will depart respectively from electricity-conductive plates 341 and 342 to cause electric-disconnection being set up between switch contact sheets 302.*b* and 302.B.

FIGS. 4A, 4B, 4C and 4D are some sectional views used to concretely introduce the working principle about turning switch to be turned from a control-position to next control-position. At different control-position, the groups of switch contact sheets will set up different electrically connected circuit as a closed loop for electric appliance.

Although in fact, the switchover work is implemented by the interaction from camshaft mechanism 201 and executive mechanism 202, which are coupled together, for more distinctly to introduce the working principle, in FIG. 3B yet are provided two sectional views along lines B-B and C-C to show the change of relative position of camshaft circular disc 220 and driving cam 208 in practical work. From B-B section the change of relative position of driving cam 208 may be distinctly observed; from C-C section the change of relative position of camshaft circular disc 220 may be distinctly observed FIG. 4A shows the circumstance of relative position of camshaft circular disc 220 and driving cam 208 when turning switch is at initial position. As shown in C-C section of FIG. 4A (i.e. sectional view along line C-C in FIG. 3A), upper pawl device 250 include upper pawl arm 252, upper pawl 255, which is at fore end of upper pawl arm 252; through pin 253 upper pawl arm 252 may be rotatablely assembled on upper housing 311. One end of exterior spring 251 clasps upper pawl arm 252, another end clasps pin 254, pin 254 is fixed on upper housing 311. Similarly, lower pawl arm 262 may be rotatablely assembled on lower housing 312 by pin 263, one end of exterior spring 261 clasps lower pawl arm 262, another end clasps pin 264, pin 264 is fixed on lower housing 312.

Exterior springs 251 and 261 apply pre-tensile force (or offset force) respectively to pawl arm 252 and to pawl arm 262 resulted in that pawls 255 and 265 respectively have a tendency to move toward the center of camshaft. Therefore, once a positioning slot 212 rotates to a position where pawl 255 or 265 exists, pawl 255 or 265 will speedily fall into positioning slot 212.

As shown in C-C section of FIG. 4A (i.e. sectional view along line C-C in FIG. 3A), when turning switch is at initial position, pawl 255 on upper pawl device 250 falls into positioning slot $\mathbf{212}_A$ to lock camshaft mechanism 201 unable to rotate; pawl 265 on lower pawl device 260 is at an intermediate position between positioning slots $\mathbf{212}._B$ and $\mathbf{212}._C$. It should be noted that: in width direction only a portion of pawl 255 falls into positioning slot 212, the residual portion of pawl 255 will rest on the rim of driving cam 208 (see pawl 255 in B-B section).

As shown in B-B section FIG. 4A (i.e. sectional view along line B-B in FIG. 3A), when turning switch is at initial position, in width direction a portion of upper pawl 255 rests on the rim of driving cam 208 and at an intermediate position between angular shape teeth $\mathbf{235}._A$ and $\mathbf{235}._B$; In width direction a portion of lower pawl 265 rests on the top of angular shape tooth $\mathbf{235}._C$ of driving cam 208.

When turning switch is at initial position as shown in FIG. 4A, sector shape groove 211 on camshaft circular disc 220 and sector shape groove 222 on driving cam 208 are fully gathered together to form an empty chamber, in this case that the interior spring 213 contained in the empty chamber is not compressed and in free state, as shown in State 1 of FIG. 2G Pawl arm also may be a resilient metal sheet made from shape memory alloy. In this case, the resilient metal sheet is directly fixed on housing, thus exterior spring may be omitted, but the pawl at the fore end of pawl arm is preset into positioning slot 212.

FIG. 4B shows the circumstance of relative position of camshaft circular disc 220 and driving cam 208 after driving cam 208 is turned an angle counterclockwise. As shown in C-C section of FIG. 4B (i.e. sectional view along line C-C in FIG. 3A), for pawl 255 falls into positioning slot $\mathbf{212}_A$ to cause camshaft mechanism 201 being locked, so camshaft circular disc 220 keeps at its position not varying. As shown in B-B section of FIG. 4B (i.e. sectional view along line B-B in FIG. 3A), when driving cam 208 is turned about 30° counterclockwise, because camshaft circular disc 220 keeps at its position not varying, sector shape groove 211 and sector shape groove 222 are staggered each other, interior spring 213 starts to be compressed and to store a certain quantity of potential energy as shown in State 2 of FIG. 2G. When driving cam 208 is being turned counterclockwise, angular shape tooth $\mathbf{235}._A$ will be gradually close to pawl 255, then pawl 255, which already fell in positioning slot $\mathbf{212}._A$, also gradually approaches the going-up slant surface on driving cam 208 (for radius $R_2$ of outer top circle of driving cam 208 is larger than radius $R_1$ of inner root circle of driving cam 208). Then pawl 255, which formerly fell in positioning slot $\mathbf{212}._A$, will be gradually pushed out from positioning slot $\mathbf{212}._A$ by the going-up slant surface.

In B-B section of FIG. 4B, pawl 265 rests on the rim of camshaft circular disc 220, for radius $R_4$ of camshaft circular disc 200 is larger than radius $R_1$ of inner root circle of driving cam 208, thus between pawl 265 and driving cam 208 remains a gap, therefore no roadblock will interfere the turning of driving cam 208.

FIG. 4C shows the circumstance of relative position of camshaft circular disc 220 and driving cam 208 after driving cam 208 is continuously turned an angle counterclockwise. As shown in B-B section of FIG. 4C (i.e. sectional view along line B-B in FIG. 3A), after driving cam is turned about 55° counterclockwise, pawl 255 in positioning slot $\mathbf{212}._A$ gradually approaches the top point of the going-up slant surface of driving cam 208 (i.e. the top of angular shape tooth $\mathbf{212}._A$), in this time, going-up slant surface pushes pawl 255 almost but not completely out from positioning slot $\mathbf{212}._A$. Therefore, camshaft circular disc 220 yet keeps in its original position not varying, sector shape groove 211 and sector shape groove 222 are further staggered each other, and interior spring 213 also is further compressed.

FIG. 4D shows the circumstance of relative position of camshaft circular disc 220 and driving cam 208, when driving cam 208 is continuously turned to 60° counterclockwise.

As shown in B-B section of FIG. 4D (i.e. sectional view along line B-B in FIG. 3A), when driving cam 208 is turned 60° (a step angle), upper pawl 255 is just at the top of angular shape tooth $\mathbf{235}._A$, thus upper pawl 255, which formerly fell in positioning slot $\mathbf{212}._A$, is pushed completely out from positioning slot $\mathbf{212}._A$.

As shown in C-C section of FIG. 4D (i.e. sectional view along line C-C in FIG. 3B), camshaft circular disc 220 is turned counterclockwise by the pushing of resilient force of compressed interior spring 213, as for the circumstance when upper pawl 255 at the top of angular shape tooth $\mathbf{235}._A$, see B-B section of FIG. 4D. When camshaft circular disc 220 is turned 60° counterclockwise, under the action of pulling force of exterior spring 261, lower pawl 265 falls into positioning slot $\mathbf{212}._B$ and sends out a silvery snap, then the turning of camshaft circular disc 220 is stopped. Interior spring 213 comes back to its free state (or maybe in a state being somewhat pre-compressed) as shown in State 3 of FIG. 2G.

In this time, in B-B section of FIG. 4D (i.e. sectional view along line B-B in FIG. 3B), upper pawl 255 is at the top of angular shape tooth $\mathbf{235}._A$, lower pawl 265 is at an intermediate position between angular shape teeth $\mathbf{235}._B$ and $\mathbf{235}._C$ of driving cam 208; In C-C section of FIG. 4D (i.e. sectional view along line C-C in FIG. 3B), upper pawl 255 is at an intermediate position between positioning slots $\mathbf{212}._A$ and $\mathbf{212}._C$, lower pawl 265 falls into positioning slot $\mathbf{212}._B$.

If driving cam 208 is again turned 60° counterclockwise toward next position, angular shape teeth $\mathbf{235}._B$ of driving cam 208 will push lower pawl 265 out from positioning slot $\mathbf{212}._B$. Once lower pawl 265 is pushed out from positioning slot $\mathbf{212}._B$, due to driving of the resilient force of interior spring 213, then camshaft circular disc 220 will be turned 60° counterclockwise, upper pawl 255 falls into positioning slot $\mathbf{212}._C$, lower pawl 265 is at an intermediate position between angular shape teeth $\mathbf{235}._B$ and $\mathbf{235}._A$. Namely, camshaft circular disc 208 is turned 1200 counterclockwise every time, upper pawl 255 and lower pawl 265 in turn will fall into positioning slot 212 ($\mathbf{212}._A$, $\mathbf{212}._B$, or $\mathbf{212}._C$) a time.

As embodiment to describe the principle of the present invention in detail, the step angle in the present invention is taken as 60° (i.e. six times of step equal to 360°). Even though the step angle is changed, the principle yet will keep correct and able to get same effect of the present invention if the number of positioning slots on camshaft circular disc 220, the number of angular shape teeth on driving cam 208, and the angle included between lower pawl 265 and vertical line are changed correspondingly and suitably.

Figure 5A:
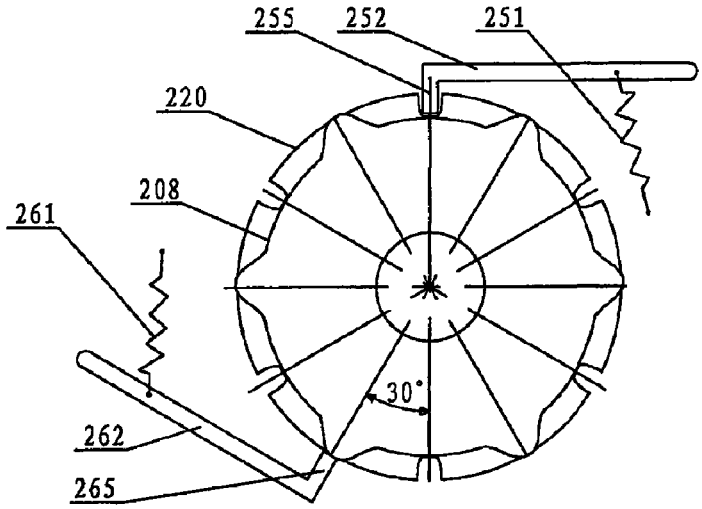
FIGS. 5A-5C show the position relation among positioning slot on camshaft circular disc 220, angular shape teeth on driving cam 208 and two pawls, when step angles are 30°, 45° and 60°.
Figure 5B:
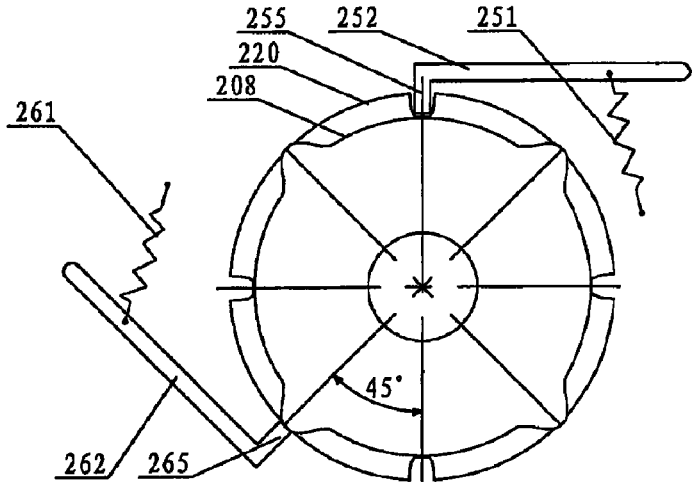
Figure 5C:
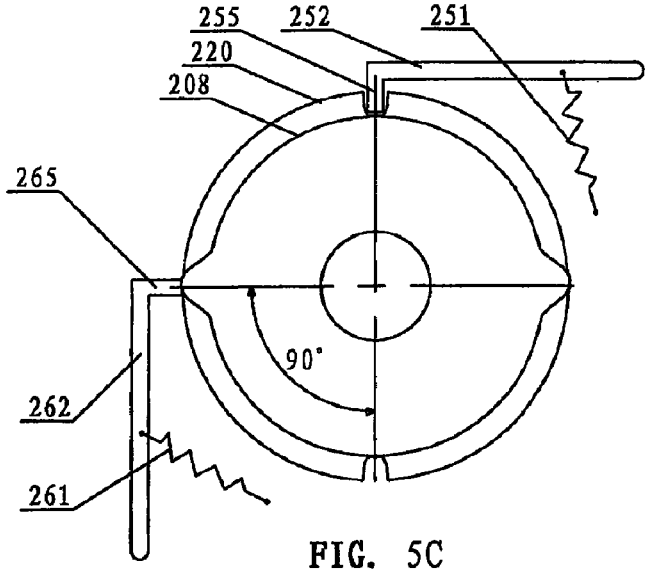

FIGS. 5A to 5C shows the positional relation among the positioning slots on camshaft circular disc 220, angular shape teeth on driving cam 208 and two paws, when step angle is taken as 30°, 45° and 90° respectively.

As shown in FIG. 5A, when step angle is taken as 30° (i.e. 12 times of step equal to 360°), the number of positioning slots on camshaft circular disc 220 is 6, the number of angular shape teeth on driving cam 208 is 6, in assembly the angular shape tooth on driving cam 208 and the positioning slot on camshaft circular disc 220 are staggered an angle of 30°; the angle included between lower pawl 265 and vertical line is 30°. Under such a condition, driving cam 208 is turned 30° every time; there exists one of pawls to fall into positioning slot.

As shown in FIG. 5B, when step angle is taken as 45° (i.e. 8 times of step equal to 360°), the number of positioning slots on camshaft circular disc 220 is 4, the number of angular shape teeth on driving cam 208 is 4, in assembly the angular shape tooth on driving cam 208 and the positioning slot on camshaft circular disc 220 are staggered an angle of 45°; the angle included between lower pawl 265 and vertical line is 45°. Under such a condition, driving cam 208 is turned 45° every time; there exists one of pawls to fall into positioning slot.

As shown in FIG. 5C, when step angle is taken as 90° (i.e. 4 times of step equal to 360°), the number of positioning slots on camshaft circular disc 220 is 2, the number of angular shape teeth on driving cam 208 is 2, in assembly the angular shape tooth on driving cam 208 and the positioning slot on camshaft circular disc 220 are staggered an angle of 90°; the angle included between lower pawl 265 and vertical line is 90°. Under such a condition, driving cam 208 is turned 90° every time; there exists one of pawls to fall into positioning slot.

Additionally, in the embodiment of the present invention, the ratchet mechanism of the present invention is used for turning switch. As known by those skilled in the art, the ratchet mechanism of the present invention also may be widely used for other occasions where the function of non-returning and positioning is needed (such as used for encoder).

The invention claimed is:

1. A ratchet wheel mechanism, comprising a camshaft circular disc (220), on the front end surface of said camshaft circular disc being disposed at least one groove (211), on the circumference of said camshaft circular disc being disposed a plurality of positioning slots (212);

a driving cam (208), on the front end surface of said driving cam being disposed at least one groove (222) corresponding to said groove (211) on said camshaft circular disc, on the rim of said driving cam being disposed a plurality of angular-shaped teeth (235);

a first pawl (255) and a second pawl (265);

after the front end surface of said camshaft circular disc and the front end surface of said driving cam engaging each other, said groove (211) on said camshaft circular disc and said groove (222) on said driving cam forming at least one empty chamber (231), at least one resilient element (213) being positioned in said empty chamber (231);

when said camshaft circular disc being at a control position, said first pawl falling into a positioning slots of said camshaft circular disc to lock said camshaft circular disc at said control position;

when said driving cam starting to rotate toward a next control position, said camshaft circular disc staying at its place, said groove (211) on said camshaft circular disc and said groove (222) on said driving cam being staggered each other to compress said resilient element to store resilient potential energy;

when said driving cam rotating to the next control position, one of said angular-shaped teeth pushing said first pawl out from one of said positioning slots, said resilient element pushing said camshaft circular disc to turn to the next control position, said second pawl falling into another one of said positioning slots of said camshaft circular disc to lock said camshaft circular disc at the next control position.

2. A ratchet wheel mechanism according to claim 1, wherein the rear end surface of said camshaft circular disc is connected with a camshaft (215).

3. A ratchet wheel mechanism according to claim 2, wherein said at least one groove (211) on the front end surface of said camshaft circular disc is two fan-shaped grooves;

said at least one groove (222) on the front end surface of said driving cam is two fan-shaped grooves;

said two fan-shaped grooves on the front end surface of said camshaft circular disc and said two fan-shaped grooves on the front end surface of said driving cam form two empty chambers, two resilient elements being positioned in said two empty chambers.

4. A ratchet wheel mechanism according to claim 2, wherein said two pawls are poisoned at two pawls arms respectively, said two pawls arms being connected with two spring devices to apply offset force on said two pawls.

5. A ratchet wheel mechanism according to claim 4, wherein said plurality of positioning slots (212) on the circumference of said camshaft circular disc are three positioning slots;

said plurality of angular-shaped teeth (235) on the rim of said driving cam are three angular-shaped teeth.

6. A ratchet wheel mechanism according to claim 4, wherein said plurality of positioning slots (212) on the circumference of said camshaft circular disc are six positioning slots;

said plurality of angular-shaped teeth (235) on the rim of said driving cam are six angular-shaped teeth.

7. A ratchet wheel mechanism according to claim 4, wherein said plurality of positioning slots (212) on the circumference of said camshaft circular disc are four positioning slots;

said plurality of angular-shaped teeth (235) on the rim of said driving cam are four angular-shaped teeth.

8. A ratchet wheel mechanism according to claim 4, wherein said plurality of positioning slots (212) on the circumference of said camshaft circular disc are two positioning slots;

said plurality of angular-shaped teeth (235) on the rim of said driving cam are two angular-shaped teeth.

9. A turning switch with a ratchet wheel mechanism, said ratchet wheel mechanism comprising a camshaft mechanism (201), said turning switch having a plurality of contact sheets, wherein said camshaft mechanism (201) having a camshaft circular disc (220), on the front end surface of said camshaft circular disc being disposed at least one groove (211), on the circumference of said camshaft circular disc being disposed a plurality of positioning slots (212), a plurality of cams provided on said camshaft for controlling said plurality of contact sheets, when said camshaft rotating to different control positions, different electrically connected circuits set up by said plurality of contact sheets;

a driving cam (208), on the front end surface of said driving cam being disposed at least one groove (222) corresponding to said groove (211) on said camshaft circular disc, on the rim of said driving cam being disposed a plurality of angular-shaped teeth (235);

a first pawl (255) and a second pawl (265);

after the front end surface of said camshaft circular disc and the front end surface of said driving cam engaging each other, said groove (211) on said camshaft circular disc and said groove (222) on said driving cam forming at least one empty chamber (231), at least one resilient element (213) being positioned in said empty chamber (231);

when said camshaft circular disc being at a control position, said first pawl falling into a positioning slots of said camshaft circular disc to lock said camshaft circular disc at the control position, the cam on said camshaft setting up said plurality of contact sheets as an electrically connected circuit;

when said driving cam starting to rotate toward a next control position, said camshaft circular disc staying at its place, said groove (211) on said camshaft circular disc and said groove (222) on said driving cam being staggered each other to compress said resilient element to store resilient potential energy;

when said driving cam rotating to the next control position, one of said angular-shaped teeth pushing said first pawl out from one of said positioning slots, said resilient element pushing said camshaft circular disc to turn to the next control position, said second pawl falling into another one of said positioning slots of said camshaft circular disc to lock said camshaft circular disc at the next control position, when said camshaft circular disc being at the next control position, the cam on said camshaft setting up said plurality of contact sheets as another electrically connected circuit.

10. A turning switch according to claim 9, wherein the rear end surface of said camshaft circular disc is connected with a camshaft (215).

11. A turning switch according to claim 10, wherein said two pawls are poisoned at two pawl arms respectively, said two pawl arms being connected with two spring devices to apply offset force on said two pawls.

12. A turning switch according to claim 11, wherein said at least one groove (211) on the front end surface of said camshaft circular disc is two fan-shaped grooves;

said at least one groove (222) on the front end surface of said driving cam is two fan-shaped grooves;

said two fan-shaped grooves on the front end surface of said camshaft circular disc and said two fan-shaped grooves on the front end surface of said driving cam form two empty chambers, two resilient elements being positioned in said two empty chambers.

13. A turning switch according to claim 11, wherein said plurality of positioning slots (212) on the circumference of said camshaft circular disc are three positioning slots;

said plurality of angular-shaped teeth (235) on the rim of said driving cam are three angular-shaped teeth.

14. A ratchet wheel mechanism according to claim 11, wherein said plurality of positioning slots (212) on the circumference of said camshaft circular disc are six positioning slots;

said plurality of angular-shaped teeth (235) on the rim of said driving cam are six angular-shaped teeth.

15. A ratchet wheel mechanism according to claim 11, wherein said plurality of positioning slots (212) on the circumference of said camshaft circular disc are four positioning slots;

said plurality of angular-shaped teeth (235) on the rim of said driving cam are four angular-shaped teeth.

16. A ratchet wheel mechanism according to claim 11, wherein said plurality of positioning slots (212) on the circumference of said camshaft circular disc are two positioning slots;

said plurality of angular-shaped teeth (235) on the rim of said driving cam are two angular-shaped teeth.

* * * * *